US008276678B2

(12) United States Patent
Burnett et al.

(10) Patent No.: US 8,276,678 B2
(45) Date of Patent: Oct. 2, 2012

(54) SUPPORT ASSEMBLY FOR A DEFORMABLE SEALING ELEMENT FOR A DOWNHOLE TOOL

(75) Inventors: William Stephen Burnett, Aberdeen (GB); Michael Adam Reid, Aberdeen (GB)

(73) Assignee: Red Spider Technology Limited, Westhill, Aberdeenshire (GB)

( * ) Notice: Subject to any disclaimer, the term of this patent is extended or adjusted under 35 U.S.C. 154(b) by 366 days.

(21) Appl. No.: 12/657,251

(22) Filed: Jan. 15, 2010

(65) Prior Publication Data

US 2010/0186970 A1 Jul. 29, 2010

(30) Foreign Application Priority Data

Jan. 19, 2009 (GB) ..... 0900846.7

(51) Int. Cl.
*E21B 23/00* (2006.01)
*E21B 33/128* (2006.01)

(52) U.S. Cl. ..... 166/387; 166/135; 277/339; 277/340; 277/341; 277/342; 277/619

(58) Field of Classification Search ..... 166/381, 166/383, 387, 118, 135, 192; 277/337–342, 277/607, 619, 624
See application file for complete search history.

(56) References Cited

U.S. PATENT DOCUMENTS 3,285,343 A * 11/1966 Urbanosky ..... 166/134
3,288,222 A * 11/1966 Urbanosky ..... 166/192
3,298,440 A * 1/1967 Current ..... 277/340
3,554,280 A 1/1971 Tucker
4,745,972 A 5/1988 Bell et al.
5,676,384 A 10/1997 Culpepper
6,666,275 B2 12/2003 Neal et al.
6,695,051 B2 2/2004 Smith et al.
6,769,491 B2 * 8/2004 Zimmerman et al. ..... 166/387
2003/0226660 A1 12/2003 Winslow et al.
2004/0007366 A1 1/2004 McKee et al.
2006/0005963 A1 1/2006 Hiorth et al.

FOREIGN PATENT DOCUMENTS

GB 2308138 A 6/1997
GB 2357098 A 6/2001
WO WO-03058026 A1 7/2003
WO WO-2007119052 A1 10/2007

OTHER PUBLICATIONS

UK Search report dated Apr. 8, 2010 issued in corresponding UK application No. GB1000485.1.
UK Search Report dated Aug. 13, 2008 issued in corresponding UK application No. GB0713919.9.
Mesquite Oil Tools, Inc. product sheet(s).

* cited by examiner

*Primary Examiner* — Shane Bomar
*Assistant Examiner* — Catherine Loikith
(74) *Attorney, Agent, or Firm* — Ladas & Parry LLP

(57) ABSTRACT

A support assembly for a deformable sealing element of a downhole tool, such as a packer or a bridge plug. The assembly comprises a first and a second support device. The first and the second support devices each comprise at least one support member which support member includes a plurality of segments located on an outer surface thereof, the segments being arranged such that when moved radially outwardly they maintain a continuous surface abutting the respective end of the sealing element. A downhole tool having a deformable sealing element and including a support assembly for a deformable sealing element is described.

28 Claims, 4 Drawing Sheets

SUPPORT ASSEMBLY FOR A DEFORMABLE SEALING ELEMENT FOR A DOWNHOLE TOOL

BACKGROUND OF THE INVENTION

1. Field of the Invention

The present invention relates to a support assembly for a deformable sealing element of a downhole tool, a downhole tool having a deformable sealing element, and to a method of supporting a deformable sealing element of a downhole tool. In particular, but not exclusively, the present invention relates to a support assembly for a deformable sealing element of a downhole tool such as a packer or a bridge plug.

2. Description of Related Art

As is well known in the oil and gas exploration and production industry, a wellbore is drilled from surface in order to gain access to subterranean hydrocarbon deposits (oil and gas). During the drilling and completion of a wellbore, it is frequently necessary to isolate and thus seal-off a portion of the wellbore. For example, the production tubing is typically located within and sealed relative to the casing/liner using a 'packer'. Packers are also used in other downhole procedures, including intervention operations, where a remedial action is to be carried out downhole. Packers typically include a deformable sealing element which, when the packer is activated, are compressed axially, urging the sealing element radially outwardly into sealing abutment with an inner wall of the casing/liner.

Other types of downhole tools include similar deformable sealing elements. Typical such tools include 'bridge plugs' used to isolate part of a wellbore, and 'straddles' which may be required in circumstances where a tubing has corroded, leading to unwanted fluid ingress/egress. Where a tubing has corroded, a straddle including a pair of spaced deformable sealing elements is run downhole to straddle across the corroded section. A first such element is located uphole of the corroded section, and a second such sealing element downhole of the corroded section. In this fashion, when the straddle is activated, the sealing elements are both urged outwardly into sealing engagement with the inner wall of the tubing, to bridge across and isolate the corroded section, thereby preventing further unwanted fluid ingress/egress.

Typically, the deformable sealing elements of tools such as packers, bridge plugs, straddles and the like are of an elastomeric material which, when compressed axially, deform radially outwardly into abutment with the respective downhole tubing. If or when it is desired to remove the tools from the wellbore, the tool is actuated to release an applied compressive axial loading, moving the sealing element out of abutment with the tubing in question, so that the tool may be returned to surface.

However, loads applied to the sealing element when it is compressed and urged into abutment with the tubing can cause a permanent deformation of the sealing element, making it difficult to retract the element from abutment with the tubing, thereby hampering return of the tool to surface. If the element does not retract sufficiently the tool may stick as the element, when retracted, is sized to fit through any restrictions in the tubing.

Furthermore, the loads applied to the sealing elements can result in the sealing element extruding axially along the wellbore, reducing the sealing effect and potentially leading to seal failure.

In an effort to address these problems and deficiencies, it has become common practice to incorporate 'garter' springs into axial ends of the sealing elements. Garter springs typically comprise inner and outer coil springs wound in opposite directions which are moulded into annular elastomeric sections of a harder, less compressible material than a main portion of the sealing element, which are bonded to the main portion. In use, it has been found that, following deformation of the sealing element, the outer and inner coil springs tend to become interengaged, and elastomeric material tends to penetrate the coils. This results in the garter springs becoming permanently deformed such that, when a deformation load applied to the sealing element is removed, the garter springs do not completely retract to their undeformed positions. This ultimately leads to a permanent deformation of the sealing element and the problems highlighted above. Also, this permanent deformation requires complete replacement of the sealing element before the tool can be reused.

The present applicants have proposed an improved support assembly for a deformable sealing element in UK patent application no. 0713919.9, being incorporated herein by reference. In an embodiment, there is shown an arrangement with two thin expandable rings positioned either side of a sealing element. Under axially compressive loads, the rings are designed to expand along with the element until they touch the inner surface of the tubing. The ring's primary role is to give the elastomeric sealing element strength when trying to bridge a gap between the outer diameter of the bridge plug or packer and the inner diameter of the tubing or casing. The rings ability to expand is due to a series of relatively narrow slots cut into the rings by means of laser or wire eroding methods. This slot pattern allows the rings to expand, and if designed correctly will allow the rings to retract due to the elasticity of the ring material. However, in practice, though this arrangement worked well with regards to allowing the element to survive extrusion failure and pressure tests were performed with ease, some elastomeric extrusion into the slots occurred and this led to problems when recovering the sealing system through a restriction. When subjected to pressure differentials and elevated temperature, elastomeric material migrated into the slots on these rings (which are slightly wider when expanded) greatly reducing the rings ability to retract when loads were removed.

It is amongst the objects of at least one embodiment of the present invention to obviate or mitigate at least one of the foregoing disadvantages.

SUMMARY OF THE INVENTION

According to a first aspect of the present invention, there is provided a support assembly for a deformable sealing element of a downhole tool, the support assembly comprising:

a first support device adapted to be located adjacent a first end of a deformable sealing element of a downhole tool; and a second support device adapted to be located adjacent a second end of the sealing element;

wherein the first and second support devices each comprise at least one elastically deformable support member adapted to be located between the respective end of the sealing element and an actuating member of the downhole tool; and a guide member having an inclined guide surface along which the support member travels when a force is exerted on the sealing element by the respective actuating member to expand the sealing element radially into abutment with a surface downhole, the guide member acting to move the support member radially outwardly to thereby support the respective end of the sealing element during deformation and characterised in that the at least one support member includes a plurality of segments located on an outer surface thereof, the segments being arranged such that when moved radially outwardly they maintain a continuous surface abutting the respective end of the sealing element.

By providing a support assembly in which the deformable sealing element is supported and a continuous surface offering a circumferential seal is maintained between the assembly and the element, a tendency of the sealing element to extrude axially relative to the downhole tool is greatly reduced.

Furthermore, by providing a support assembly in which the support member provides a continuous side surface towards the outer surface there is a reduced opportunity for an elastomeric material to migrate into slots or opening in the expanded support member.

Advantageously, the segments are wedges, arranged to be alternately inwardly and outwardly facing. In this way, radial deformation will cause inner, outwardly facing wedges to press against outer, inwardly facing wedges, and maintain a continuous circumferential face between the wedges as they are moved radially outwardly.

Preferably, the inner wedges have an apex shaped to match a radius of curvature of the respective base of the adjacent outer wedges. In this way, the radius of curvature can be selected to equal the radius of curvature of the tubing against which the sealing element will seal. Advantageously, when expanded, the segments provide a continuous surface against the sealing element.

The support members of each support device may be adapted to extend radially on exertion of an expansion force on the sealing element, to thereby support the sealing element. The support members may be generally annular members having inner and outer surfaces describing respective inner and outer diameters of the support members, and the support members may be configured such that cooperation with the respective guide members (on exertion of the force on the sealing element) results in an increase in both the inner and outer diameters of the support members. When the expansion load is removed, the support members may return fully or at least substantially to an undeformed state, wherein the inner and outer diameters of the support members are the same as or substantially similar to the respective diameters prior to exertion of the force.

The support members may each take the form of a spring or a sprung member, and may comprise a plurality of slots, channels or the like extending through a wall thereof, on which the segments are located. The slots may extend through the support members in an axial direction (relative to the downhole tool) and part way along the support member in a radial direction (relative to the downhole tool). The slots may be configured such that at least one dimension of the slots increases on exertion of the force on the sealing element, to facilitate the radial movement of the support member to thereby support the sealing element.

A portion of an outer surface of the sprung member may be removed to accommodate the segments. More preferably, an annular portion is removed from a side of the sprung member facing the sealing element. The segments may be mechanically attached to the sprung member. Preferably, the segments interlock with one or more protrusions on the surface of the sprung member.

Preferably, the support members are each adapted to be located in sliding contact/abutment with the guide surfaces of the respective guide members, and may comprise inclined surfaces adapted to cooperate with the inclined guide surfaces of the guide members, to facilitate passage of the support members along and thus relative to the guide members.

An at least one support member of the support devices may comprise an inclined abutment surface for facilitating movement of the support member radially inwardly and thus retraction of the sealing element from abutment with the downhole surface. The inclined abutment surface may facilitate retraction of the sealing element, in the unlikely event that the sealing element becomes stuck in an expanded position, by interaction with a downhole formation such as a shoulder, edge or other surface of a downhole component.

References herein to the support members travelling along the inclined guide surface include the support members being in direct abutment with and thus in sliding contact with the guide surface, as well as the support members being mounted via an intermediate member so that the support members move relative to the surface.

Furthermore, references herein to the guide surfaces of the guide members being inclined (as well as references to other inclined surfaces) are to the guide surfaces being inclined relative to a main axis of the downhole tool on which the sealing element is mounted.

According to a second aspect of the present invention, there is provided a downhole tool comprising:

a deformable sealing element adapted to be expanded radially into abutment with a tubular surface downhole;

a first actuating member located adjacent a first end of the sealing element;

a second actuating member located adjacent a second end of the sealing element;

a first support device located adjacent the first end of the sealing element; and a second support device located adjacent the second end of the sealing element;

wherein the first and second support devices are each according to the first aspect.

Advantageously, the inner wedges have an apex shaped to match a radius of curvature of the respective base of the adjacent outer wedges and this radius of curvature is substantially the same as the radius of curvature of the tubular surface.

The actuating members may each comprise an abutment surface on an end thereof, the abutment surface adapted to abut a respective support member to facilitate transmission of an expansion force on the sealing element. The actuating members may also each comprise a recess or cutaway in the ends thereof, at least part of the recess located radially inwardly of the abutment surface, the recess adapted to receive the guide member when the actuating member exerts the expansion force on the sealing element.

At least one, optionally both of the actuating members may be mounted for movement relative to a main body of the tool, for exerting an expansion force on the sealing element. The actuating members may be annular members and may take the form of pistons and thus may be fluid actuated, or may be mechanically or electro-mechanically actuated members.

The first and second ends of the sealing element may comprise abutment surfaces adapted to abut the respective support members, to facilitate transmission of an expansion force on the sealing element. The sealing elements may also each comprise a recess or cutaway in the ends thereof, at least part of the recess located radially inwardly of the abutment surface, the recess adapted to receive the guide member. This may facilitate abutment of the sealing element with the support members, for transmission of an expansion force on the sealing element, whilst permitting direct (or indirect) contact of the support members with the guide member for movement radially outwardly.

In embodiments of the invention, the downhole tool may be a packer, a bridge plug or a straddle. However, it will be understood that the principles of the present invention are applicable to a wide range of types of downhole tool requiring or incorporating a deformable sealing element. Indeed, the present invention has a potential utility outwith the field of downhole tools, and thus in further aspects of the invention, alternative tools may be provided having the features of the downhole tool defined above. For example, tools to be used in pipelines or other flowlines may be provided having the features of the downhole tool defined above.

According to a third aspect of the present invention, there is provided an elastically deformable support member for a support device of a downhole tool adapted to support a sealing element during deformation, the support member adapted to be located between an end of a sealing element on a downhole tool and an actuating member of the tool and being adapted to travel along an inclined guide surface of a guide member of the support device when a force is exerted on the sealing element to expand the sealing element radially into abutment with a surface downhole, so that the support member moves radially outwardly to thereby support the end of the sealing element during deformation and maintain a continuous surface abutting the respective end of the sealing element.

Further features of the elastically deformable support member are defined above in relation to the first aspect of the present invention.

According to a fourth aspect of the present invention, there is provided a method of supporting a deformable sealing element of a downhole tool during radial expansion into abutment with a surface downhole, the method comprising the steps of:

mounting a first support device adjacent a first end of a deformable sealing element on a downhole tool;

mounting a second support device adjacent a second end of the sealing element;

exerting a force on the sealing element using a first actuating member located adjacent the first end of the sealing element and a second actuating element located adjacent the second end of the sealing element, to expand the sealing element into abutment with a surface downhole; and transmitting the force exerted on the sealing element by the first and second actuating members through respective first and second support devices located adjacent the respective first and second ends of the sealing element, to cause elastically deformable support members of each support device to travel along inclined guide surfaces of respective guide members of the devices such that the support members move radially outwardly to thereby support the respective ends of the sealing element during deformation and segments arranged on an outer surface of the support members maintain a continuous surface against the respective end of the sealing element.

BRIEF DESCRIPTION OF THE DRAWINGS

Embodiments of the present invention will now be described, by way of example only, with reference to the accompanying drawings, in which.

DETAILED DESCRIPTION OF PREFERRED EMBODIMENTS

Figure 1:
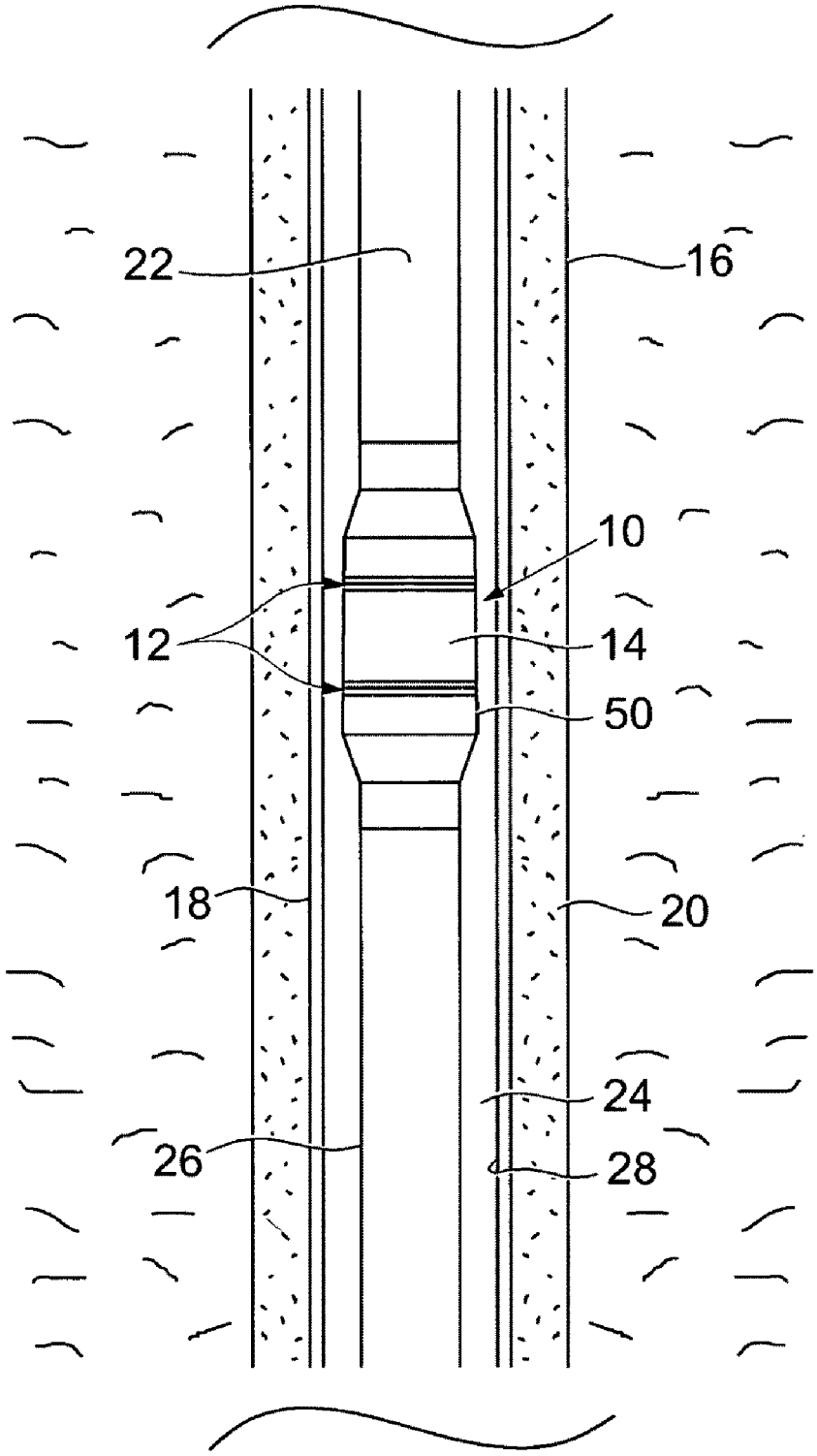
FIG. 1 is a schematic, partial longitudinal sectional view of a downhole tool in the form of a packer, the packer comprising a support assembly for a deformable sealing element, in accordance with an embodiment of the present invention, the packer shown prior to actuation.

Referring initially to FIG. 1, there is shown a schematic, partial longitudinal sectional view of a downhole tool in the form of a packer 10, the packer 10 comprising a support assembly 12 for a deformable sealing element 14, in accordance with an embodiment of the present invention.

The packer 10 has been run-in to a wellbore 16 which has been drilled from surface to a desired depth and lined with a steel casing 18 that has been cemented in place using cement 20, in a fashion known in the art. The packer 10 is a production packer, provided as part of a string of production tubing 22 which has been run-in to the cased wellbore 16. The packer 10 is activated to seal off an annulus 24 defined between an outer surface 26 of the production tubing 22 below the packer 10 and an inner wall 28 of the casing 18. In this fashion, well fluids entering the casing 18 are directed up through the production tubing 22 to surface.

Figure 2:
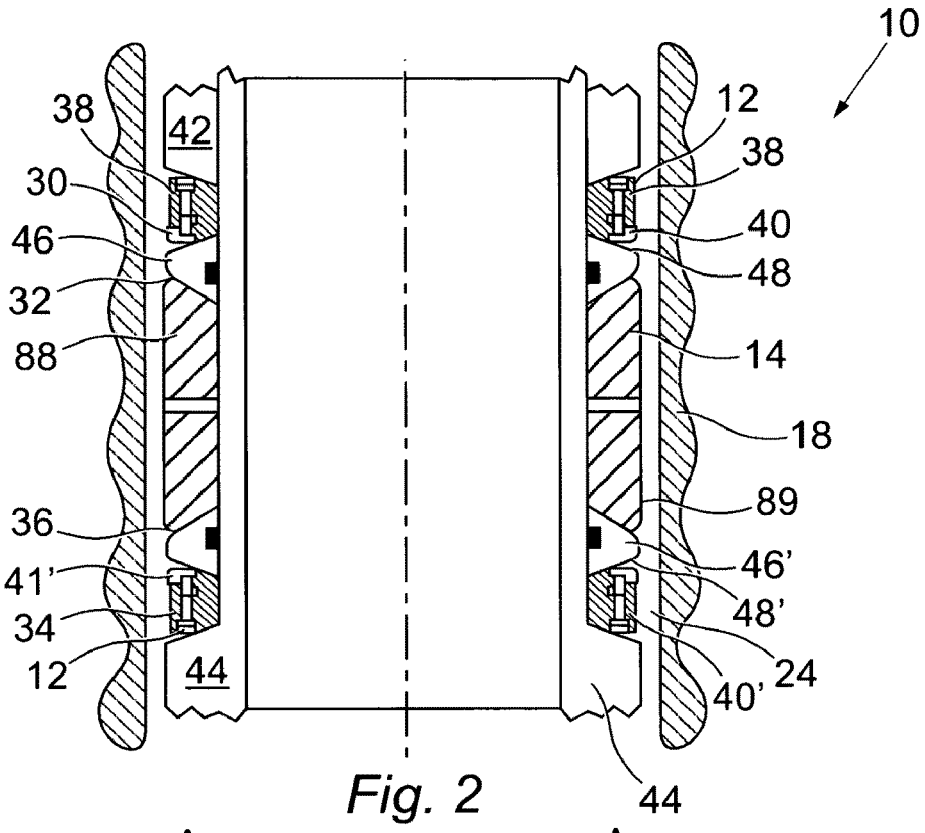
FIG. 2 is an enlarged, longitudinal sectional view of part of part of the packer shown in FIG. 1, illustrating the support assembly in more detail.

The support assembly 12 is shown in more detail in the enlarged, longitudinal sectional view of FIG. 2, and generally comprises a first support device 30 located adjacent a first end 32 of the sealing element 14, and a second support device 34 located adjacent a second end 36 of the sealing element 14. The first and second support devices 30 and 34 each comprise at least one elastically deformable support member 38, 38' respectively. Each support member 38, 38' includes a first annular member 40, 40' upon which is located a second annular member 41, 41'. The annular members 40, 40', 41 and 41' will be described hereinafter with reference to FIG. 4. The support members 38, 38' are located between the respective ends 32, 34 of the sealing element and actuating members 42, 44 on the packer 10.

The support assemblies 30, 34 also comprise respective guide members 46, 46', each being a cone, providing inclined guide surfaces 48, 48', the support members 38 and 38', travelling along (relative to) the surfaces 48, 48' when a force is exerted on the sealing element 14 by the respective actuating members 42 and 44. As will be described in more detail below, a force is exerted on the sealing element 14 to expand the sealing element 14 radially into abutment with a surface downhole which, in the illustrated embodiment, is the casing inner wall 28. In use, the guide members 46, 46' act to move the support members 38 and 38' radially outwardly, to thereby support the respective ends 32 and 36 of the sealing element 14 during deformation. The sealing element 14 is shown following deformation and expansion into contact with the casing inner wall 28 in FIG. 3, which is a view similar to that of FIG. 2.

Figure 3:
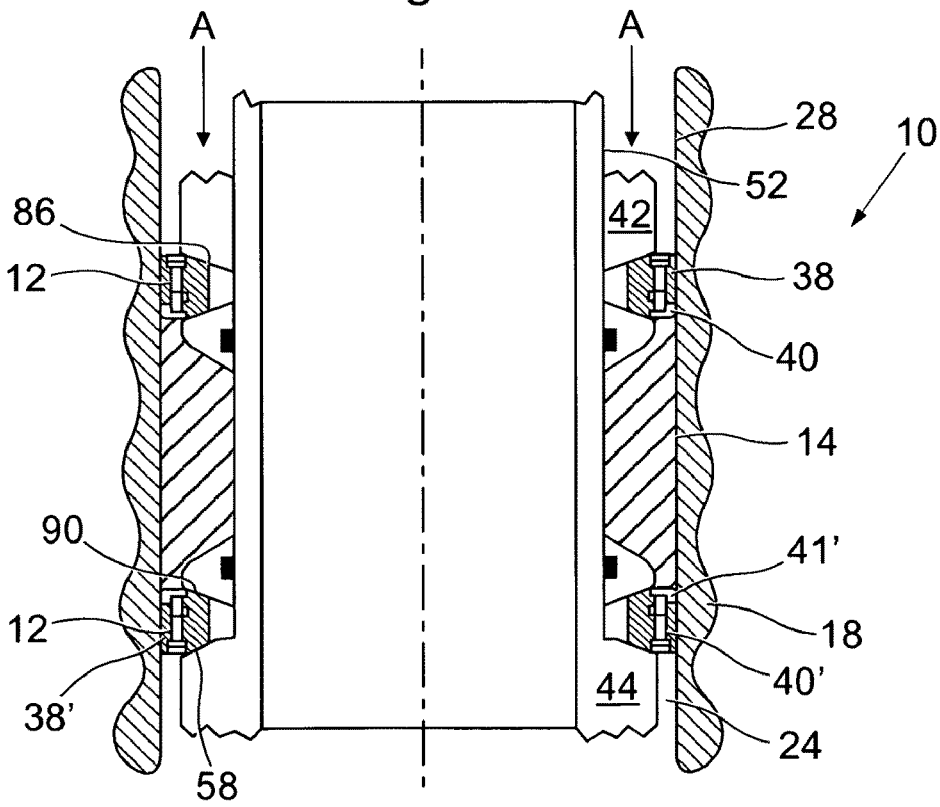
FIG. 3 is a view of the packer of FIG. 1, similar to the view of FIG. 2, but showing the support assembly following actuation of the packer.

As illustrated particularly in FIG. 3, during exertion of an expansion force on the sealing element 14, which compresses the sealing element to urge it radially outwardly, the support members 38 and 38' travel along the inclined guide surfaces 48, 48' and are thus carried radially outwardly. This maintains the support members 38 and 38' in positions where they support the axial ends 32 and 36 of the sealing element 14, thereby preventing extrusion of the sealing element along the wellbore 16 and thus holding the sealing element in a shape which provides a good sealing abutment with the casing inner wall 28.

Furthermore, as the support members 38 and 38' are elastically deformable, when the expansion force exerted on the sealing element 14 is removed, the support members 38 and 38' may return radially inwardly towards their starting positions shown in FIG. 2, by return travel along the inclined guide surfaces 48, 48'. The expansion force may be removed, in the event that it is desired to pull the production tubing 22 from the wellbore 18, for example, to perform a workover operation or to shut-in the well. Following removal of the expansion force, and exertion of a pull force on the packer 10 (through the production tubing 22), elastic recovery of the support members 38 and 38' thus returns them inwardly so as not to define an upset on an outer surface 50 of the packer 10, which could otherwise hamper recovery of the production tubing 22 (for example, through contact between one of the support members 38 and 38' and a shoulder, ledge or the like uphole of the packer 10).

Figure 4:
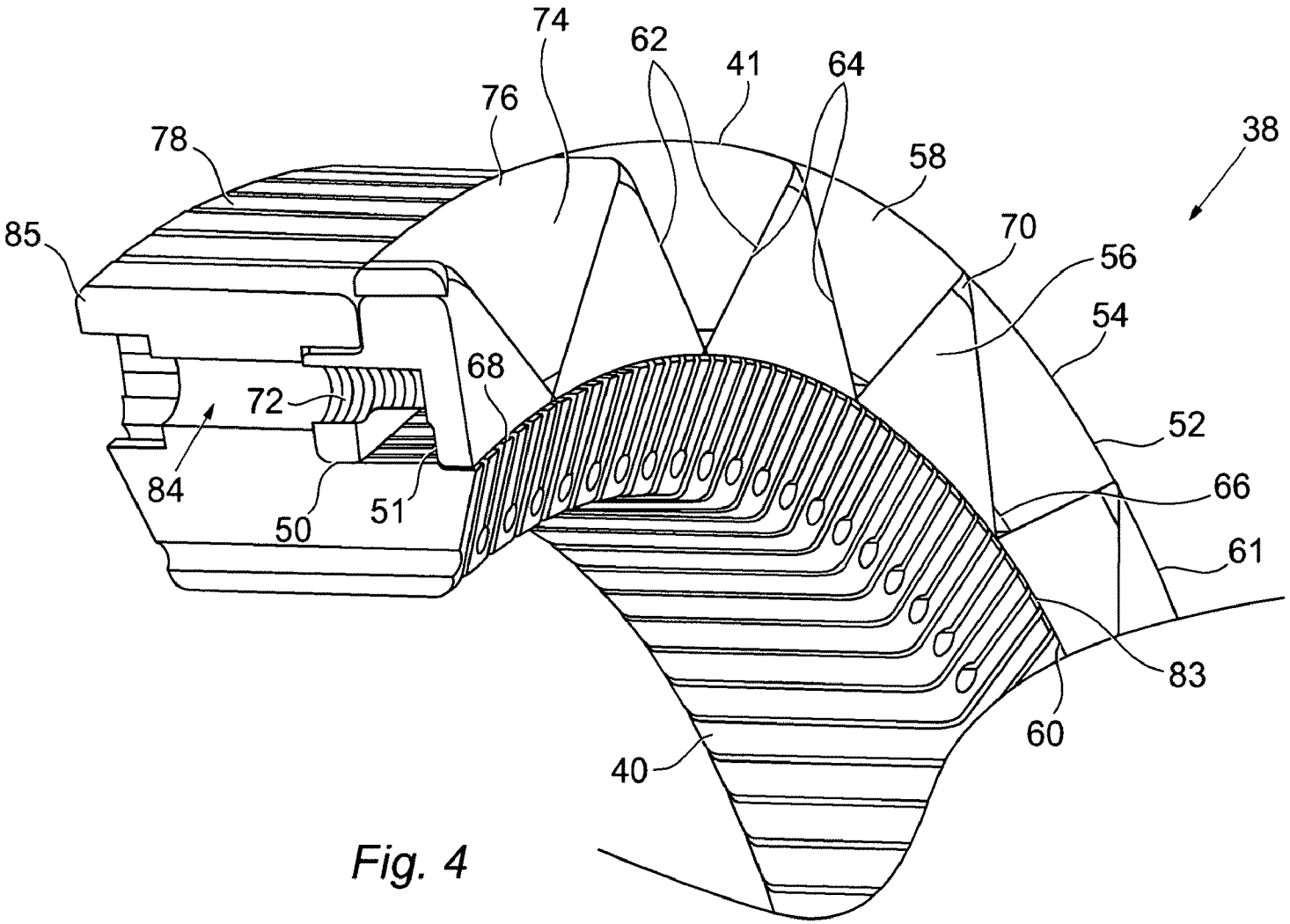
FIG. 4 is an enlarged sectional view through a support member forming part of the support assembly of FIGS. 1 to 3.
Figure 5:
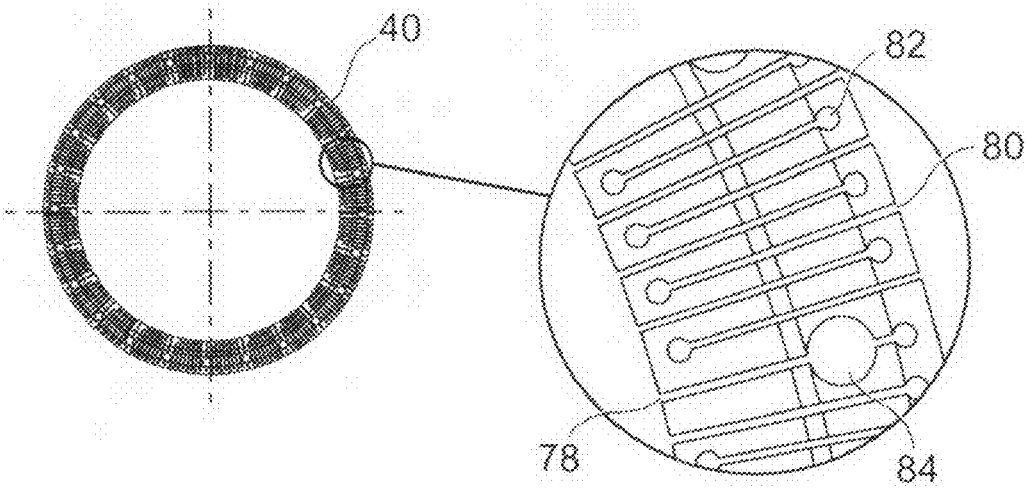
FIG. 5A is an end view of a first end of a support member forming part of the support assembly of FIGS. 1 to 3.
FIG. 5B is an enlarged end view of a first end of a support member forming part of the support assembly of FIGS. 1 to 3.
Figure 6:
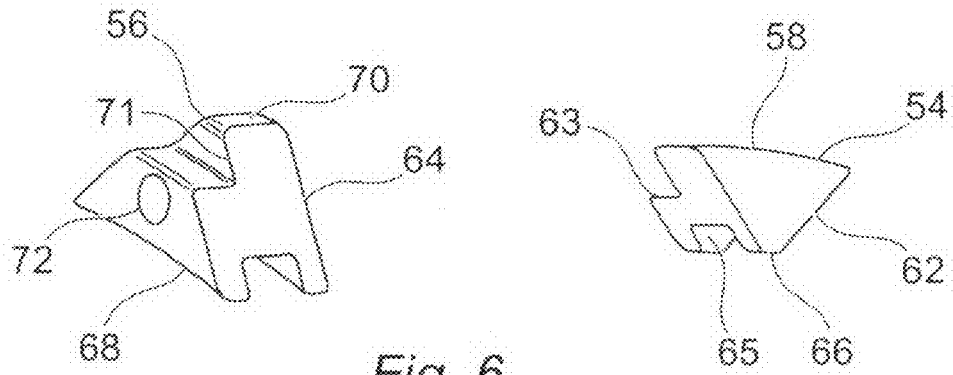
FIG. 6 is a schematic view of an (a) inner and (b) outer wedge of the support assembly of FIG. 4.
Figure 7:
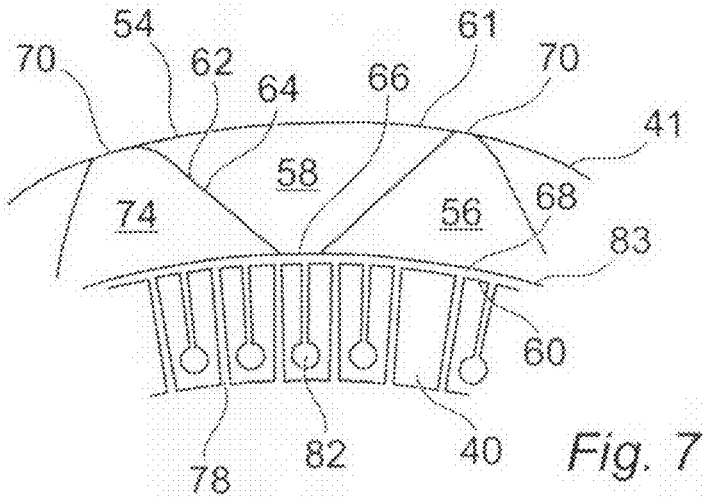
FIG. 7 is an end view of a part of a second end of the support member of FIG. 4.

The support member 38 is shown in more detail in the part sectional view of FIG. 4 as well as in the further enlarged detail views of FIGS. 5, 6 and 7, which show portions of the support member. It will be understood that each of the support members 38 and 38' are of similar construction.

The support member 38 comprises two annular members 40 and 41. The first annular member 40 is constructed from an annular ring of a metal such as steel. As best shown in FIG. 5A and 5B, a number of radial slots are laser cut in the annular ring, and these include a number of inner slots 78, and a number of outer slots 80. The inner and outer slots 78, 80 are spaced alternately around a circumference of the annular ring and each terminates in a substantially circular aperture 82. Such apertures 82 assist in allowing the member 40 to expand as it is increased radially outwardly and also retract when released. This gives the ring a sprung nature so that the ring is flexible and can take up a number of shapes. In this way, though the ring may ideally remain circular in shape, it can become oval, for example, to match any distortion in the other components.

At regular intervals access apertures 84 are also cut from the member. Access apertures 84 provide clearance for the insertion of screws to hold the first 40 and second 41 annular members to each other. The access apertures 84 are elongate to allow the cap screws to move as the support member is radially expanded or contracted.

Referring to FIG. 4, a portion of the first annular member 40 is cut away to facilitate location of the second annular member 41. A recess 50 in the first annular member 40, together with a ridge, or lug, located circumferentially at the aperture 51 provides for an interlocking arrangement to hold the second annular member 41 within the first 40. The ridge is split at an aperture 51 to allow segments 56, 58 to be inserted into the recess 50 and then moved over the ridge to interlock therewith.

The second annular member comprises a plurality of segments 56, 58. Support member 38 is therefore wider than the prior art support members. Each segment is substantially a wedge, there being inner wedges 56 and outer wedges 58, which are oppositely arranged around a circumference 60 of the first annular member 40. The wedges are best seen with the aid of FIG. 6. The outer wedges 58 provide a base 54 with a first radius of curvature 61, side walls 62 which abut corresponding side walls 64 on the inner wedges 56 and a rounded apex 66 having a second radius of curvature 83. A lip 63 is formed to interlock in recess 50 on the first annular member 40 and a square cross sectional recess 65 is provided on an inner circumference of the wedge 58 to engage with the ridge.

The inner wedges 56 provide a base 68 with the second radius of curvature 83, side walls 64 which abut corresponding side walls 62 on the outer wedges 58 and a rounded apex 70 having the first radius of curvature 61. There is also a lip 71 to engage the recess 50 and a square cross sectional recess 65 is provided on an inner circumference of the wedge 56 to engage with the ridge. Additionally, the inner wedges 56 have a threaded bore 72, located on a portion of the wedge 56 within the recess 50. In this way a cap screw (not shown) can be inserted through the access aperture 84 on the first annular member 40 and used to loosely fit each inner wedge 56 to the first annular member 40. This arrangement also ensures that the wedges 56, 58 are evenly distributed around the circumference 60.

The guide members 46, 46' are provided as annular rings which are generally wedge-shaped in cross-section, to define the inclined guide surfaces 48. The guide members 46, 46' are slidably mounted on the main mandrel 52.

In use, the actuating member 42 takes the form of a sleeve which is movably mounted on a main mandrel 52 of the packer 10, see FIG. 1. In a fashion known in the art, the sleeve 42 is typically initially held against movement relative to the mandrel 52 by an arrangement of shear pins (not shown), to prevent premature setting of the packer 10. The actuating member 44 also takes the form of a sleeve, but is secured against movement relative to the mandrel 52. The production tubing 22, carrying the packer 10, is run into the casing 18 and set-down on the bottom of the wellbore 16. The packer 10 is then activated by setting weight down on the packer, which shears the pins holding the actuating sleeve 42 against movement relative to the mandrel 52. The sleeve 42 is then free to move downhole by a compressive load applied in the direction of arrows A.

The support member 38 of the first support device 30 is located between and in abutment with a surface 86 of the actuating sleeve 42, and the guide member 46. In turn, the guide member 46 abuts a surface 88 of the end 32 of the sealing element 14.

In a similar fashion, the support member 38' of the second support device 34 is located between and in abutment with a surface 58 of the fixed sleeve 44, and the guide member 46'. In turn, the guide member 46' abuts a surface 90 of the end 36 of the sealing element 14.

Each support member 38, 38' is arranged such that an open face 74 of the second annular member 41 abuts the guide surface 48. In the retracted or run-in position, the second annular member 41 provides a ring having an outer surface 76 of abutting bases 54 of the outer wedges 58, which sits upon and is proud of the outer surface 78 of the first annular member 40. The side walls 62, 64 of the segments 56, 58 all meet to provide a continuous surface on the open face 74.

Accordingly, when the actuating sleeve 42 is freed for movement relative to the mandrel 52, and weight is set down on the packer 10, an expansion force is transmitted to the sealing element 14 through the abutment surface 86 of sleeve 42, the support member 38 acting on the guide member 46 which in turn acts on surface 88 of the sealing element 14. Movement of the sealing element 14 down hole is resisted through abutment between the surface 89 of the sealing element 14, the guide member 46' and, in turn, the support member 38' acting on the surface 59 of the fixed sleeve 44. The axially directed force exerted on the sealing element 14 by the actuating sleeve 42 is thus resisted by the fixed sleeve 44. The sealing element, which is typically of an elastomeric material, is then compressed axially and, as a result, expands radially outwardly into sealing abutment with the casing wall 28, as shown in FIG. 3.

During exertion of an expansion load on the sealing element 14, a circumferential width of the slots 78 and 80 increases as the support members 38, 38' travel along the inclined guide surface 48, thereby permitting a circumferential expansion of the support member, which facilitates the desired radial movement to the position shown in FIG. 3. As the first member 40 expands radially outwardly, the second member 41 is forced to expand also and pushes the segments 56, 58 radially outwardly. During this expansion, the side walls 62 and 64 remain in sealing contact so that a continuous surface is maintained on the open face 74. The rounded apexes 70 rise to meet the bases 54 and thereby provide an outer surface 76 having the first radius of curvature 61. Advantageously, the first radius of curvature is selected to be the radius of curvature of the inner wall 28 of the casing 18. Similarly, the bases 68 of the inner wedges 56 will move radially outwards to meet the rounded apexes 66 of the outer wedges 58. The second annular member thus provides a circumferential inner surface having the second radius of curvature 83. Preferably the surface 60 of the first annular member 40 matches the second radius of curvature 83. In this way a ring having a continuous surface is formed on the face 74.

When expanded, face 74 supports the end 32 of the sealing element 14. Accordingly the same occurs at the other end 36 of the sealing element 14. As shown in FIG. 3, only the second annular member 41 is exposed to the elastomeric material of the sealing element 14. As the second annular member 41 provides a face 74 having a continuous surface with no gaps, crevices or recesses against the sealing element 14, the elastomeric material is prevented from extruding axially past the guide members 46, 46'.

When the compressive load is removed, with sleeve 42 being raised, the sealing element 14 retracts back to its initial configuration. The support members 38, 38' also retract back down the incline 48, 48' due to the sprung nature of the first annular member 40. The segments 56, 58 will slide relative to each other while maintaining a substantially continuous surface on the face 74.

An edge portion 85 of the support member 38 is tapered in order to assist in retraction of the support member radially inwardly, in the event that the support member becomes stuck in an extended position, by interaction with a formation downhole.

The packer 10 is then configured as per FIG. 2 and can be retrieved from the well bore 16. As the sealing element 14 has been prevented from extruding into the support devices 30, 34, the assembly can be used again.

It is thus a principal advantage of the present invention to provide a support assembly for a deformable sealing element of a downhole tool, a downhole tool having a deformable sealing element, and a method of supporting a deformable sealing element of a downhole tool in which, the sealing element is supported upon a continuous surface during radial expansion.

Various modifications may be made to the foregoing without departing from the spirit and scope of the present invention.

For example, it will be understood that the principles of the present invention are applicable to a wide range of types of downhole tool requiring or incorporating a deformable sealing element, including other types of packers or straddles. Indeed, the present invention has a potential utility outwith the field of downhole tools, and thus in further aspects of the invention, alternative tools may be provided having the features of the downhole tool defined above. For example, tools to be used in pipelines or other flowlines may be provided having the features of the downhole tool defined above.

Optionally, both of the actuating members are mounted for movement relative to a main body of the tool, for exerting an expansion force on the sealing element. The actuating members may take the form of pistons and thus may be fluid actuated, or may be mechanically or electro-mechanically actuated members.

The support members may each be adapted to be located in sliding contact/abutment with the guide surfaces of the respective guide members, and may comprise inclined surfaces adapted to cooperate with the inclined guide surfaces of the guide members, to facilitate passage of the support members along and thus relative to the guide members.

Other interlocking arrangements between the first and second annular members 40,41 can be used. For example, the cap screws may be removed. However, an even distribution of wedges around the circumference is required and without the cap screws the wedges are apt to migrate to a lower side.

The invention claimed is:

1. A support assembly for a deformable sealing element of a downhole tool, the support assembly comprising:

a first support device adapted to be located adjacent a first end of a deformable sealing element of a downhole tool; and a second support device adapted to be located adjacent a second end of the sealing element;

wherein the first and second support devices each comprise at least one elastically deformable support member adapted to be located between the respective end of the sealing element and an actuating member of the downhole tool; and a guide member having an inclined guide surface along which the support member travels when an expansion force is exerted on the sealing element by the respective actuating member to expand the sealing element radially into abutment with a surface downhole, the guide member acting to move the support member radially outwardly to thereby support the respective end of the sealing element during deformation and characterised in that the at least one support member includes a plurality of segments located on an outer surface thereof, wherein the segments are wedges arranged to be alternately inwardly and outwardly facing and the segments are arranged such that when moved radially outwardly the segments maintain a continuous surface abutting the respective end of the sealing element.

2. A support assembly according to claim 1, wherein the support member provides a continuous side surface towards the outer surface thereof.

3. A support assembly according to claim 1, wherein the inwardly facing wedges have an apex shaped to match a radius of curvature of the respective base of the adjacent outwardly facing wedges.

4. A support assembly according to claim 1, wherein the support members of each support device are adapted to extend radially on exertion of an expansion force on the sealing element, to thereby support the sealing element.

5. A support assembly according to claim 1, wherein the support members are generally annular members having inner and outer surfaces describing respective inner and outer diameters of the support members, and the support members are configured such that cooperation with the respective guide members on exertion of the force on the sealing element results in an increase in both the inner and outer diameters of the support members.

6. A support assembly according to claim 5, wherein, when the expansion force is removed, the support members return fully or at least substantially to an undeformed state, wherein the inner and outer diameters of the support members are the same as or substantially similar to the respective diameters prior to exertion of the force.

7. A support assembly according to claim 1, wherein the support members each take the form of a spring or a sprung member.

8. A support assembly according to claim 7, wherein the support members comprise a plurality of slots or channels extending through a wall thereof, on which the segments are located.

9. A support assembly according to claim 8, wherein the slots extend through the support members in an axial direction relative to the downhole tool and part way along the support member in a radial direction relative to the downhole tool.

10. A support assembly according to claim 8, wherein the slots are configured such that at least one dimension of the slots increases on exertion of the force on the sealing element, to facilitate the radial movement of the support member to thereby support the sealing element.

11. A support assembly according to claim 7, wherein a portion of an outer surface of the sprung member is removed to accommodate the segments.

12. A support assembly according to claim 11, wherein an annular portion is removed from a side of the sprung member facing the sealing element.

13. A support assembly according to claim 7, wherein the segments are mechanically attached to the sprung member.

14. A support assembly according to claim 7, wherein the segments interlock with one or more protrusions on the surface of the sprung member.

15. A support assembly according to claim 1, wherein the support members are each adapted to be located in sliding contact/abutment with the guide surfaces of the respective guide members.

16. A support assembly according to claim 15, wherein the support members comprise inclined surfaces adapted to cooperate with the inclined guide surfaces of the guide members, to facilitate passage of the support members along and thus relative to the guide members.

17. A support assembly according to claim 1, wherein an at least one support member of the support devices comprises an inclined abutment surface for facilitating movement of the support member radially inwardly and thus retraction of the sealing element from abutment with the downhole surface.

18. A downhole tool comprising:

a support assembly according to claim 1;

a deformable sealing element adapted to be expanded radially into abutment with a tubular surface downhole;

a first actuating member located adjacent a first end of the sealing element; and a second actuating member located adjacent a second end of the sealing element;

wherein the first support device of the support assembly is located adjacent the first end of the sealing element; and the second support device of the support assembly is located adjacent the second end of the sealing element.

19. A downhole tool according to claim 18, wherein the inwardly facing wedges of the support assembly have an apex shaped to match a radius of curvature of a respective base of the adjacent outwardly facing wedges of the support assembly and this radius of curvature is substantially the same as the radius of curvature of the tubular surface.

20. A downhole tool according to claim 18, wherein the actuating members each comprise an abutment surface on an end thereof, the abutment surface being adapted to abut a respective support member of the support assembly to facilitate transmission of an expansion force on the sealing element.

21. A downhole tool according to claim 20, wherein the actuating members also each comprise a recess or cutaway in the ends thereof, at least part of the recess located radially inwardly of the abutment surface, the recess being adapted to receive the guide member when the actuating member exerts the expansion force on the sealing element.

22. A downhole tool according to claim 18, wherein at least one of the actuating members is mounted for movement relative to a main body of the tool, for exerting an expansion force on the sealing element.

23. A downhole tool according to claim 18, wherein the actuating members are annular members.

24. A downhole tool according to claim 23, wherein the actuating members take the form of pistons.

25. A downhole tool according to claim 18, wherein the first and second ends of the sealing element comprise abutment surfaces adapted to abut the respective support members of the support assembly, to facilitate transmission of an expansion force on the sealing element.

26. A downhole tool according to claim 25, wherein the sealing element also comprises a recess or cutaway in the ends thereof, at least part of the recess located radially inwardly of the abutment surface, the recess adapted to receive the guide member.

27. A downhole tool according to claim 18, wherein the downhole tool is a packer, a bridge plug or a straddle.

28. A method of supporting a deformable sealing element of a downhole tool during radial expansion into abutment with a surface downhole, the method comprising the steps of:

mounting a first support device adjacent a first end of a deformable sealing element on a downhole tool;

mounting a second support device adjacent a second end of the sealing element;

exerting a force on the sealing element using a first actuating member located adjacent the first end of the sealing element and a second actuating element located adjacent the second end of the sealing element, to expand the sealing element into abutment with a surface downhole; and transmitting the force exerted on the sealing element by the first and second actuating members through respective first and second support devices located adjacent the respective first and second ends of the sealing element, to cause elastically deformable support members of each support device to travel along inclined guide surfaces of respective guide members of the devices such that the support members move radially outwardly to thereby support the respective ends of the sealing element during deformation, wherein the support members include a plurality of segments arranged on an outer surface, wherein the segments are wedges arranged to be alternately inwardly and outwardly facing and the segments are arranged such that when moved radially outwardly the segments maintain a continuous surface against the respective end of the sealing element.

* * * * *